US010204566B2

(12) United States Patent
Nie

(10) Patent No.: US 10,204,566 B2
(45) Date of Patent: Feb. 12, 2019

(54) LIQUID CRYSTAL DISPLAY DEVICE AND COMPENSATION CIRCUIT OF ORGANIC LIGHT-EMITTING DIODE THEREOF

(71) Applicant: Shenzhen China Star Optoelectronics Technology Co., Ltd., Shenzhen, Guangdong (CN)

(72) Inventor: Chenglei Nie, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 274 days.

(21) Appl. No.: 15/109,877

(22) PCT Filed: May 10, 2016

(86) PCT No.: PCT/CN2016/081505
§ 371 (c)(1),
(2) Date: Jul. 6, 2016

(87) PCT Pub. No.: WO2017/156846
PCT Pub. Date: Sep. 21, 2017

(65) Prior Publication Data

US 2018/0190209 A1 Jul. 5, 2018

(30) Foreign Application Priority Data

Mar. 15, 2016 (CN) ..... 2016 1 01482462

(51) Int. Cl.
*G09G 3/34* (2006.01)
*G09G 3/3233* (2016.01)

(52) U.S. Cl.
CPC ..... *G09G 3/3406* (2013.01); *G09G 3/3233* (2013.01); *G09G 3/34* (2013.01);
(Continued)

(58) Field of Classification Search
CPC ..... G09G 3/3406; G09G 2300/0866; G09G 2320/045
See application file for complete search history.

(56) References Cited

U.S. PATENT DOCUMENTS

2003/0095087 A1 5/2003 Libsch et al.
2009/0002356 A1 1/2009 Sumioka et al.
(Continued)

FOREIGN PATENT DOCUMENTS

CN 101013725 A 8/2007
CN 101192372 A 6/2008
(Continued)

*Primary Examiner* — Charles Hicks
(74) *Attorney, Agent, or Firm* — Andrew C. Cheng

(57) ABSTRACT

The disclosure discloses a liquid crystal display device and a compensation circuit of an organic light emitting diode thereof. The compensation circuit at least includes: a first switch unit, a second switch unit, a third switch unit and a fourth switch unit, when the first switch unit is off, the second switch unit, the third switch unit and the fourth switch unit are on, the compensation circuit drives the organic light-emitting diode to irradiate, in order to compensate the organic light-emitting diode. By the manner above, the disclosure can prevent influence of drift of the threshold voltage of the thin film transistor on the current passing through the organic light-emitting diode.

19 Claims, 2 Drawing Sheets

(52) U.S. Cl.
CPC ..... *G09G 2300/0866* (2013.01); *G09G 2320/045* (2013.01)

(56) References Cited

U.S. PATENT DOCUMENTS

| | | | | |
|---|---|---|---|---|
| 2011/0074757 | A1* | 3/2011 | Chung | G09G 3/3233 345/211 |
| 2012/0327058 | A1 | 12/2012 | Minami et al. | |
| 2013/0157399 | A1 | 6/2013 | Park et al. | |
| 2014/0091996 | A1* | 4/2014 | Moon | G09G 3/3685 345/92 |
| 2014/0346968 | A1 | 11/2014 | Meng et al. | |

FOREIGN PATENT DOCUMENTS

| | | | |
|---|---|---|---|
| CN | 101986378 | A | 3/2011 |
| CN | 101996582 | A | 3/2011 |
| CN | 102890910 | A | 1/2013 |
| CN | 102915703 | A | 2/2013 |
| CN | 105185299 | A | 12/2015 |
| CN | 105280141 | A | 1/2016 |
| CN | 105654901 | A | 6/2016 |

* cited by examiner

LIQUID CRYSTAL DISPLAY DEVICE AND COMPENSATION CIRCUIT OF ORGANIC LIGHT-EMITTING DIODE THEREOF

FIELD OF THE DISCLOSURE

The disclosure relates to a liquid crystal display technical field, and more particularly to a liquid crystal display device and a compensation circuit of an organic light-emitting diode thereof.

BACKGROUND OF THE DISCLOSURE

An organic light-emitting diode (OLED) is an electroluminescent device. A conventional OLED drive circuit includes two thin film transistors and a capacitor, the two thin film transistors include a switch thin film transistor and a drive thin film transistor, the switch thin film transistor is applied to control input of a data signal, the drive thin film transistor is applied to control current through the OLED. A positive drift or a negative drift of a threshold voltage of the drive thin film transistor leads to various currents passing through the OLED under the circumstances of same data signal.

The threshold voltage drift of the drive thin film transistor occurs in all the conventional thin film transistors during utilization, factors such as irradiation in oxide semiconductors, source drain electrode voltage stress make the threshold voltage of the drive thin film transistor to drift, currents through the OLED fail to attain a required value.

SUMMARY OF THE DISCLOSURE

The technical issue that the disclosure solves is to provide a liquid crystal display device and a compensation circuit of an organic light emitting diode thereof.

To solve the technical problem above, a proposal of the disclosure is: providing a compensation circuit of an organic light-emitting diode, which is coupled to the organic light-emitting diode, the compensation circuit at least includes: a first switch unit, a first terminal of the first switch unit is coupled to a first reference voltage, a second terminal of the first switch unit is coupled to a first clock signal; a second switch unit, a first terminal of the second switch unit is coupled to a third terminal of the first switch unit, a second terminal of the second switch unit is coupled to a predetermined voltage, a third terminal of the second switch unit is coupled to the organic light-emitting diode; a third switch unit, a first terminal of the third switch unit is coupled to a second reference voltage, a third terminal of the third switch unit is coupled to the organic light-emitting diode, a fourth terminal of the third switch unit is coupled to a fourth terminal of the second switch unit; a fourth switch unit, a first terminal of the fourth switch unit is coupled to a data signal, a second terminal of the fourth switch unit is coupled to a second clock signal, a third terminal of the fourth switch unit is coupled to the second terminal of the third switch unit; when the first switch unit is off, the second switch unit, the third switch unit and the fourth switch unit are on, the compensation circuit driving the organic light-emitting diode to irradiate, in order to compensate the organic light-emitting diode.

When the organic light-emitting diode is irradiating, a current of the organic light-emitting diode satisfies a following formula:

$$I=\beta*(V\text{data}-V\text{pre})^2$$

where I is the current of the organic light-emitting diode; Vdata is a voltage value of the data signal; Vpre is a voltage value of the predetermined voltage.

The first switch unit includes a first thin film transistor, a first terminal of the first thin film transistor is connected to the first reference voltage, a second terminal of the first thin film transistor is connected to the first clock signal; the second switch unit includes a second thin film transistor and a first capacitor, a first terminal of the second thin film transistor is connected to a third terminal of the first thin film transistor, a second terminal of the second thin film transistor is connected to the predetermined voltage, a third terminal of the second thin film transistor is connected to a cathode of the organic light-emitting diode, one end of the first capacitor is connected to the first terminal and a fourth terminal of the second thin film transistor, the other end of the first capacitor is connected to ground.

The third switch unit includes a third thin film transistor, a first terminal of the third thin film transistor is connected to the second reference voltage, a third terminal of the third thin film transistor is connected to the cathode of the organic light-emitting diode, a fourth terminal of the third thin film transistor is connected to the fourth terminal of the second thin film transistor.

The fourth switch unit includes a fourth thin film transistor and a second capacitor, a first terminal of the fourth thin film transistor is connected to the data signal, a second terminal of the fourth thin film transistor is connected to the second clock signal, a third terminal of the fourth thin film transistor is connected to a second terminal of the third thin film transistor, one end of the second capacitor is connected to the third terminal of the fourth thin film transistor and the second terminal of the third thin film transistor, the other end of the second capacitor is connected to ground.

The second thin film transistor and the third thin film transistor are double gate thin film transistors, the second terminal of the second thin film transistor is a bottom gate of the double gate thin film transistor, the fourth terminal of the second thin film transistor is a top gate of the double gate thin film transistor, the second terminal of the third thin film transistor is a bottom gate of the double gate thin film transistor, the fourth terminal of the third thin film transistor is a top gate of the double gate thin film transistor.

When the compensation circuit is pre-charged, the first clock signal is a high level, the second clock signal is a low level, the data signal is a low level, the first thin film transistor and the second thin film transistor are on, the fourth thin film transistor is off.

When the compensation circuit is coding, the first clock signal is a low level, the second clock signal is a low level, the data signal is a low level, the first thin film transistor is off, the second thin film transistor is on, the fourth thin film transistor is off.

When compensation circuit is driving to irradiate, the first clock signal is a low level, the second clock signal is a high level, the data signal is a high level, the first thin film transistor is off, the second thin film transistor is on, the third thin film transistor is on, the fourth thin film transistor is on.

To solve the technical problem above, another proposal of the disclosure is: providing a liquid crystal display device, which includes a backlight module and a display panel disposed on a light-emitting surface of the backlight module, the backlight module includes an organic light-emitting diode and a compensation circuit, the compensation circuit is coupled to the organic light-emitting diode, the compensation circuit at least includes: a first switch unit, a first terminal of the first switch unit is coupled to a first reference voltage, a second terminal of the first switch unit is coupled to a first clock signal; a second switch unit, a first terminal of the second switch unit is coupled to a third terminal of the first switch unit, a second terminal of the second switch unit is coupled to a predetermined voltage, a third terminal of the second switch unit is coupled to the organic light-emitting diode; a third switch unit, a first terminal of the third switch unit is coupled to a second reference voltage, a third terminal of the third switch unit is coupled to the organic light-emitting diode, a fourth terminal of the third switch unit is coupled to a fourth terminal of the second switch unit; a fourth switch unit, a first terminal of the fourth switch unit is coupled to a data signal, a second terminal of the fourth switch unit is coupled to a second clock signal, a third terminal of the fourth switch unit is coupled to the second terminal of the third switch unit; when the first switch unit is off, the second switch unit, the third switch unit and the fourth switch unit are on, the compensation circuit drives the organic light-emitting diode to irradiate, in order to compensate the organic light-emitting diode.

When the organic light-emitting diode is irradiating, a current of the organic light-emitting diode satisfies a following formula:

$$I=\beta*(V\text{data}-V\text{pre})^2$$

where I is the current of the organic light-emitting diode; Vdata is a voltage value of the data signal; Vpre is a voltage value of the predetermined voltage.

The first switch unit includes a first thin film transistor, a first terminal of the first thin film transistor is connected to the first reference voltage, a second terminal of the first thin film transistor is connected to the first clock signal; the second switch unit includes a second thin film transistor and a first capacitor, a first terminal of the second thin film transistor is connected to a third terminal of the first thin film transistor, a second terminal of the second thin film transistor is connected to the predetermined voltage, a third terminal of the second thin film transistor is connected to a cathode of the organic light-emitting diode, one end of the first capacitor is connected to the first terminal and a fourth terminal of the second thin film transistor, the other end of the first capacitor is connected to ground.

The third switch unit includes a third thin film transistor, a first terminal of the third thin film transistor is connected to the second reference voltage, a third terminal of the third thin film transistor is connected to the cathode of the organic light-emitting diode, a fourth terminal of the third thin film transistor is connected to the fourth terminal of the second thin film transistor.

The fourth switch unit includes a fourth thin film transistor and a second capacitor, a first terminal of the fourth thin film transistor is connected to the data signal, a second terminal of the fourth thin film transistor is connected to the second clock signal, a third terminal of the fourth thin film transistor is connected to a second terminal of the third thin film transistor, one end of the second capacitor is connected to the third terminal of the fourth thin film transistor and the second terminal of the third thin film transistor, the other end of the second capacitor is connected to ground.

The second thin film transistor and the third thin film transistor are both double gate thin film transistors, the second terminal of the second thin film transistor is a bottom gate of the double gate thin film transistor, the fourth terminal of the second thin film transistor is a top gate of the double gate thin film transistor, the second terminal of the third thin film transistor is a bottom gate of the double gate thin film transistor, the fourth terminal of the third thin film transistor is a top gate of the double gate thin film transistor.

When the compensation circuit is pre-charged, the first clock signal is a high level, the second clock signal is a low level, the data signal is a low level, the first thin film transistor and the second thin film transistor are on, the fourth thin film transistor is off.

When the compensation circuit is coding, the first clock signal is a low level, the second clock signal is a low level, the data signal is a low level, the first thin film transistor is off, the second thin film transistor is on, the fourth thin film transistor is off.

When compensation circuit is driving to irradiate, the first clock signal is a low level, the second clock signal is a high level, the data signal is a high level, the first thin film transistor is off, the second thin film transistor is on, the third thin film transistor is on, the fourth thin film transistor is on.

Beneficial effects of the disclosure are: distinguishing from a conventional technique, when the first switch unit is off, the second switch unit, the third switch unit and the fourth switch unit are on, the compensation circuit drives the organic light-emitting diode to irradiate, in order to compensate the organic light-emitting diode, preventing influence of drift of the threshold voltage of the thin film transistor on the current passing through the organic light-emitting diode.

DETAILED DESCRIPTION OF PREFERRED EMBODIMENTS

Embodiments of the disclosure are described in detail with reference to the accompanying drawings as follows, it is clear that the described embodiments are part of embodiments of the disclosure, but not all embodiments. Based on the embodiments of the disclosure, all other embodiments obtained by a person skilled in the art without creativity should be considered within the scope of protection of the disclosure.

Figure 1:
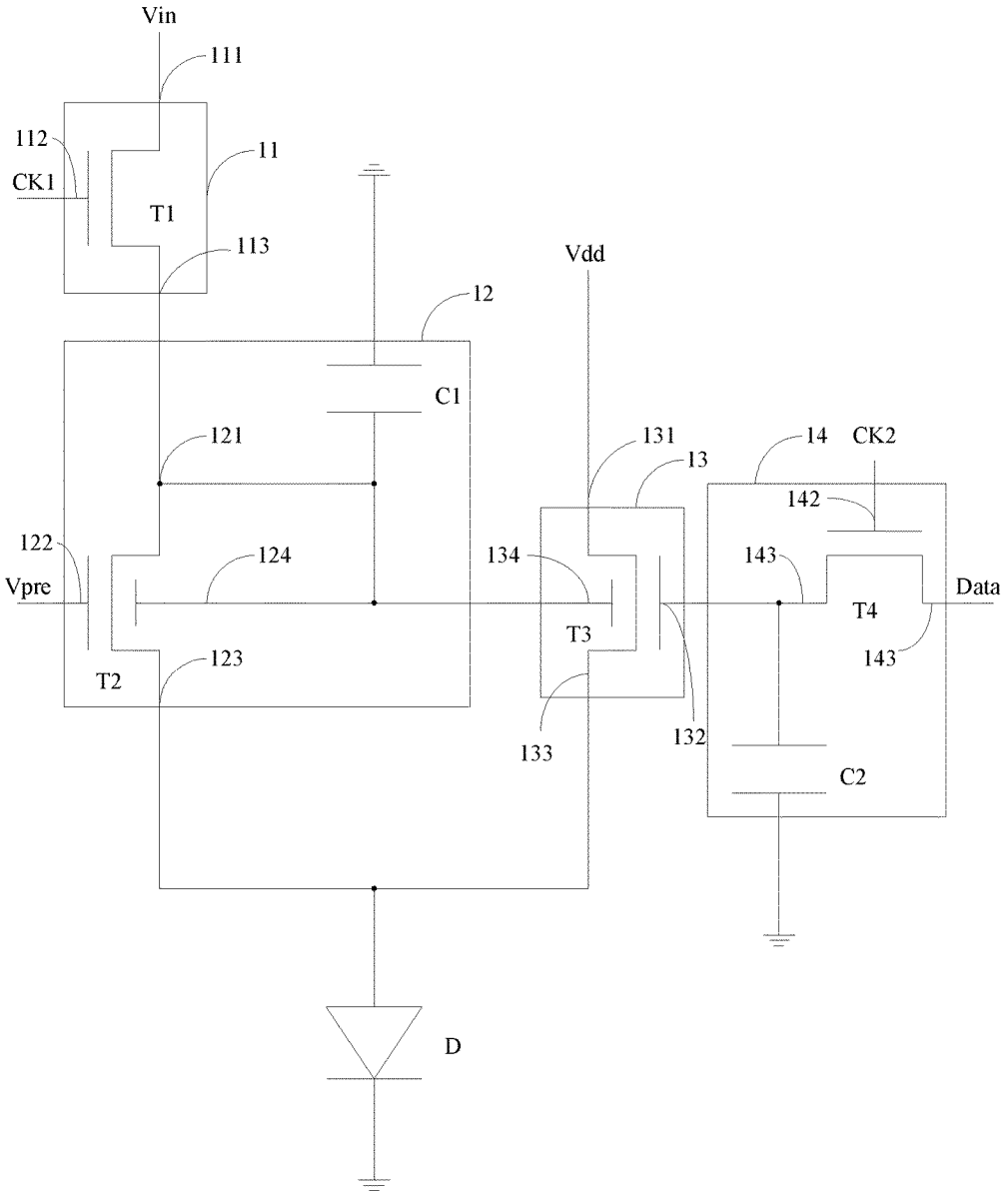
FIG. 1 is a circuit diagram of a compensation circuit of an organic light-emitting diode according to a first embodiment of the disclosure.

Referring to FIG. 1, FIG. 1 is a circuit diagram of a compensation circuit of an organic light-emitting diode according to a first embodiment of the disclosure. The compensation circuit disclosed by the embodiment is applied in the organic light-emitting diode, as shown in FIG. 1, the compensation circuit is coupled to the organic light-emitting diode, the compensation circuit at least includes: a first switch unit 11, a second switch unit 12, a third switch unit 13 and a fourth switch unit 14.

In the embodiment, a first terminal 111 of the first switch unit 11 is coupled to a first reference voltage Vin, a second terminal 112 of the first switch unit 11 is coupled to a first clock signal CK1; a first terminal 121 of the second switch unit 12 is coupled to a third terminal 113 of the first switch unit 11, a second terminal 122 of the second switch unit 12 is coupled to a predetermined voltage Vpre, a third terminal 123 of the second switch unit 12 is coupled to the organic light-emitting diode D; a first terminal 131 of the third switch unit 13 is coupled to a second reference voltage Vdd, a third terminal 133 of the third switch unit 13 is coupled to the organic light-emitting diode D, a fourth terminal 134 of the third switch unit 13 is coupled to a fourth terminal 124 of the second switch unit 12; a first terminal 141 of the fourth switch unit 14 is coupled to a data signal Data, a second terminal 142 of the fourth switch unit 14 is coupled to a second clock signal CK2, a third terminal 143 of the fourth switch unit 14 is coupled to the second terminal 132 of the third switch unit 13.

When the first switch unit 11 is off, the second switch unit 12, the third switch unit 13 and the fourth switch unit 14 are on, the compensation circuit drives the organic light-emitting diode D to irradiate, in order to compensate the organic light-emitting diode D.

Specifically, the first switch unit 11 includes a first thin film transistor T1, the first terminal 111 of the first thin film transistor T1 is connected to the first reference voltage Vin, the second terminal 112 of the first thin film transistor T1 is connected to the first clock signal CK1.

The second switch unit 12 includes a second thin film transistor T2 and a first capacitor C1, the first terminal 121 of the second thin film transistor T2 is connected to the third terminal 113 of the first thin film transistor T1, the second terminal 122 of the second thin film transistor T2 is connected to the predetermined voltage Vpre, the third terminal 123 of the second thin film transistor T2 is connected to a cathode of the organic light-emitting diode D, one end of the first capacitor C1 is connected to the first terminal 121 and the fourth terminal 124 of the second thin film transistor T2, the other end of the first capacitor C1 is connected to ground.

The third switch unit 13 includes a third thin film transistor T3, the first terminal 131 of the third thin film transistor T3 is connected to the second reference voltage Vdd, the third terminal 133 of the third thin film transistor T3 is connected to the cathode of the organic light-emitting diode D, the fourth terminal 134 of the third thin film transistor T3 is connected to the fourth terminal 124 of the second thin film transistor T2.

The fourth switch unit 14 includes a fourth thin film transistor T4 and a second capacitor C2, the first terminal 141 of the fourth thin film transistor T4 is connected to the data signal Data, the second terminal 142 of the fourth thin film transistor T4 is connected to the second clock signal CK2, the third terminal 143 of the fourth thin film transistor T4 is connected to the second terminal 132 of the third thin film transistor T3, one end of the second capacitor C2 is connected to the third terminal 143 of the fourth thin film transistor T4 and the second terminal 132 of the third thin film transistor T3, the other end of the second capacitor C2 is connected to ground, the second capacitor C2 is applied to filter waves for the data signal Data.

Preferably, the second thin film transistor T2 and the third thin film transistor T3 are both double gate thin film transistors. The first terminal 121 of the second thin film transistor T2 is a drain electrode of the double gate thin film transistor, the second terminal 122 of the second thin film transistor T2 is a bottom gate BG of the double gate thin film transistor, the third terminal 123 of the second thin film transistor T2 is a source electrode of the double gate thin film transistor, the fourth terminal 124 of the second thin film transistor T2 is a top gate TG of the double gate thin film transistor; the first terminal 131 of the third thin film transistor T3 is the drain electrode of the double gate thin film transistor, the second terminal 132 of the third thin film transistor T3 is the bottom gate BG of the double gate thin film transistor, the third terminal 133 of the third thin film transistor T3 is the source electrode of the double gate thin film transistor, the fourth terminal 134 of the third thin film transistor T3 is the top gate TG of the double gate thin film transistor. The first terminal 111 of the first thin film transistor T1 is a drain electrode, the second terminal 112 of the first thin film transistor T1 is a gate, the third electrode 113 of the first thin film transistor T1 is a source electrode; the first terminal 141 of the fourth thin film transistor T4 is a drain electrode, the second terminal 142 of the fourth thin film transistor T4 is a gate, the third terminal 143 of the fourth thin film transistor T4 is a source electrode.

Figure 2:
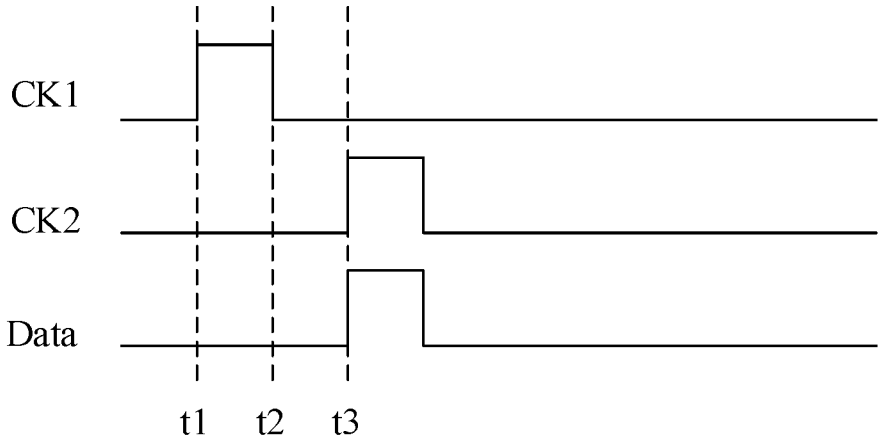
FIG. 2 is a sequence diagram of the compensation circuit shown in FIG. 1.

Referring to FIG. 2 as well, an operational principle of the compensation circuit of the embodiment is illustrated according to a sequence diagram shown in FIG. 2.

Compensation to the organic light-emitting diode D from the compensation circuit includes three sections, which are pre-charging from the compensation circuit to the organic light-emitting diode D, coding the organic light-emitting diode D by the compensation circuit and the compensation circuit driving the organic light-emitting diode D to irradiate.

When the compensation circuit is pre-charging the organic light-emitting diode D, shown as regions t1-t2 in FIG. 2, the first clock signal CK1 is a high level, the second clock signal CK2 is a low level, the data signal Data is a low level. The first thin film transistor T1 is on, the fourth thin film transistor T4 is off; a voltage Vbg2 of the second terminal of the second thin film transistor T2 is the predetermined voltage Vpre, the first terminal 111 and the third terminal 113 of the first thin film transistor T1 are connected, the first terminal 121 and the fourth terminal 124 of the second thin film transistor T2 are connected, a voltage Vtg2 of the fourth terminal 124 of the second thin film transistor T2 is the first reference voltage Vin, a voltage Vtg3 of the fourth terminal 134 of the third thin film transistor T3 is the first reference voltage Vin as well; the second thin film transistor T2 and the third thin film transistor T3 are on, the organic light-emitting diode D irradiates. As time t1-t2 for pre-charging is a few microseconds, and time for driving the organic light-emitting diode D to irradiate is tens milliseconds, influence of irradiation of the organic light-emitting diode D on the organic light-emitting diode D is little during pre-charging.

When the compensation circuit is coding the organic light-emitting diode D, shown as regions t2-t3 in FIG. 2, the first clock signal CK1 is a low level, the second clock signal CK2 is a low level, the data signal Data is a low level. The first thin film transistor T1 is off, the fourth thin film transistor T4 is off; the first terminal 121 and the fourth terminal 124 of the second thin film transistor T2 are connected, the voltage Vtg2 of the fourth terminal 124 of the second thin film transistor T2 is Vin, a threshold voltage Vth_t2 of the second thin film transistor T2 is low, the second thin film transistor T2 is on. The threshold voltage Vth_t2 of the second thin film transistor T2 is increasing along with continuous reduction of the voltage Vtg2 of the fourth terminal 124 of the second thin film transistor T2, the voltage Vtg2 of the fourth terminal 124 of the second thin film transistor T2 no longer varies until Vbg2−Vs=Vth_t2, Vs is a voltage of the third terminal 123 of the second thin film transistor T2. The voltage Vtg2 of the fourth terminal 124 of the second thin film transistor T2 is stored in the first capacitor C1, the threshold voltage Vth_t2=Vbg2−Vs=Vpre−Voled. The fourth terminal 124 of the second thin film transistor T2 and the fourth terminal 134 of the third thin film transistor T3 are connected, the second thin film transistor T2 and the third thin film transistor T3 are mirror thin film transistors, so a threshold voltage Vth_t3 of the third thin film transistor T3 equals to Vth_t2=Vpre−Voled, the fourth thin film transistor T4 is on. As time t2-t3 for coding is tens microseconds, and time for driving the organic light-emitting diode D to irradiate is tens milliseconds, influence of the irradiation of organic light-emitting diode D on the organic light-emitting diode D driving to irradiation is little during coding.

When the compensation circuit is driving the organic light-emitting diode D to irradiate, as longer than t3 in FIG. 2, the first clock signal CK1 is a low level, the second clock signal CK2 is a high level, the data signal Data is a high level. The first thin film transistor T1 is off, the second thin film transistor T2 is on, the third thin film transistor T3 is on, the fourth thin film transistor T4 is on. As the voltage Vtg2 of the fourth terminal 124 of the second thin film transistor T2 is maintained by the first capacitor C1 during coding, which can guarantee threshold voltages of the second thin film transistor T2 and the third thin film transistor T3 are Vpre-Voled. The second terminal 132 of the third thin film transistor T3 inputs a data signal Data, according to a current formula of a thin film transistor:

$$I=\beta(Vbg3-Vth_t3-Vs)^2 \quad (1)$$

where Vbg3 is a voltage Vdata of the second terminal 132 of the third thin film transistor T3, the threshold voltage Vpre-Voled of the third thin film transistor T3 is put into the formula (1) to achieve:

$$I=\beta[Vdata-(Vpre-Voled)-Voled]^2=\beta(Vdata-Vpre)^2 \quad (2)$$

According to the formula (2), the current of the organic light-emitting diode D is merely related to the data signal Data and the predetermined Vpre, when the data signal Data and the predetermined Vpre are constant, the current of the organic light-emitting diode D keeps stable to prevent influence of drift of the threshold voltage of the thin film transistor on the current passing through the organic light-emitting diode D.

Figure 3:
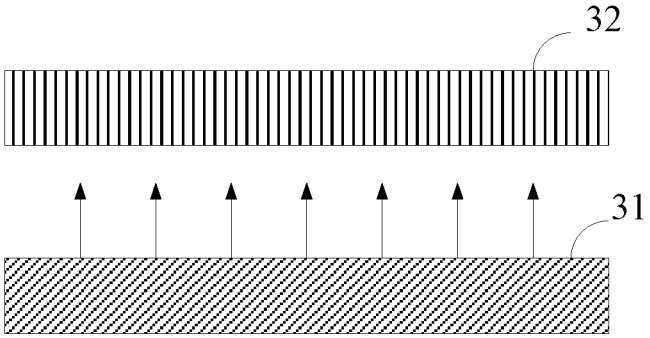
FIG. 3 is a schematic structural diagram of a liquid crystal display device according to the first embodiment of the disclosure.

The disclosure further provides a liquid crystal display, as shown in FIG. 3, the liquid crystal display disclosed by the embodiment includes: a backlight module 31 and a display panel 32 disposed on a light-emitting surface of the backlight module 31, the backlight module 31 includes the organic light-emitting diode D described in the embodiments above, the organic light-emitting diode D is applied to provide light to the backlight module 31, the backlight module 31 further includes the compensation circuit described in the embodiments above, repeated description is omitted.

The current of the organic light-emitting diode D of the liquid crystal display device disclosed by the embodiment keeps stable to prevent influence of drift of the threshold voltage of the thin film transistor on the current passing through the organic light-emitting diode D, which can make the display panel 32 to irradiate evenly.

In summary, according to the disclosure, when the first switch unit is off, the second switch unit, the third switch unit and the fourth switch unit are on, the compensation circuit drives the organic light-emitting diode to irradiate, in order to compensate the organic light-emitting diode, preventing influence of drift of the threshold voltage of the thin film transistor on the current passing through the organic light-emitting diode.

Above are merely embodiments of the disclosure, which do not limit the scope of the disclosure, any modifications, equivalent replacements or improvements within the spirit and principles of the embodiments described above should be covered by the protected scope of the disclosure.

What is claimed is:

1. A compensation circuit of an organic light-emitting diode, wherein the compensation circuit is coupled to the organic light-emitting diode, the compensation circuit at least comprises:

a first switch unit, a first terminal of the first switch unit being coupled to a first reference voltage, a second terminal of the first switch unit being coupled to a first clock signal;

a second switch unit, a first terminal of the second switch unit being coupled to a third terminal of the first switch unit, a second terminal of the second switch unit being coupled to a predetermined voltage, a third terminal of the second switch unit being coupled to the organic light-emitting diode;

a third switch unit, a first terminal of the third switch unit being coupled to a second reference voltage, a third terminal of the third switch unit being coupled to the organic light-emitting diode, a fourth terminal of the third switch unit being coupled to a fourth terminal of the second switch unit;

a fourth switch unit, a first terminal of the fourth switch unit being coupled to a data signal, a second terminal of the fourth switch unit being coupled to a second clock signal, a third terminal of the fourth switch unit being coupled to the second terminal of the third switch unit;

wherein each of the first switch unit, the second switch unit, the third switch unit and the fourth switch unit corresponds to only one corresponding transistor respectively such that on/off state of each of the first switch unit, the second switch unit, the third switch unit and the fourth switch unit is determined by the only one corresponding transistor respectively, when the first switch unit is off, the second switch unit, the third switch unit and the fourth switch unit are on, the compensation circuit driving the organic light-emitting diode to irradiate, in order to compensate the organic light-emitting diode.

2. The compensation circuit according to claim 1, wherein when the organic light-emitting diode is irradiating, a current of the organic light-emitting diode satisfies a following formula:

$$I=\beta*(Vdata-Vpre)^2$$

where I is the current of the organic light-emitting diode; Vdata is a voltage value of the data signal; Vpre is a voltage value of the predetermined voltage.

3. The compensation circuit according to claim 1, wherein the first switch unit comprises a first thin film transistor, a first terminal of the first thin film transistor is connected to the first reference voltage, a second terminal of the first thin film transistor is connected to the first clock signal;

the second switch unit comprising a second thin film transistor and a first capacitor, a first terminal of the second thin film transistor being connected to a third terminal of the first thin film transistor, a second terminal of the second thin film transistor being connected to the predetermined voltage, a third terminal of the second thin film transistor being connected to a cathode of the organic light-emitting diode, one end of the first capacitor being connected to the first terminal and a fourth terminal of the second thin film transistor, the other end of the first capacitor being connected to ground.

4. The compensation circuit according to claim 3, wherein the third switch unit comprises a third thin film transistor, a first terminal of the third thin film transistor is connected to the second reference voltage, a third terminal of the third thin film transistor is connected to the cathode of the organic light-emitting diode, a fourth terminal of the third thin film transistor is connected to the fourth terminal of the second thin film transistor.

5. The compensation circuit according to claim 4, wherein the fourth switch unit comprises a fourth thin film transistor and a second capacitor, a first terminal of the fourth thin film transistor is connected to the data signal, a second terminal of the fourth thin film transistor is connected to the second clock signal, a third terminal of the fourth thin film transistor is connected to a second terminal of the third thin film transistor, one end of the second capacitor is connected to the third terminal of the fourth thin film transistor and the second terminal of the third thin film transistor, the other end of the second capacitor is connected to ground.

6. The compensation circuit according to claim 5, wherein the second thin film transistor and the third thin film transistor are double gate thin film transistors, the second terminal of the second thin film transistor is a bottom gate of the double gate thin film transistor, the fourth terminal of the second thin film transistor is a top gate of the double gate thin film transistor, the second terminal of the third thin film transistor is a bottom gate of the double gate thin film transistor, the fourth terminal of the third thin film transistor is a top gate of the double gate thin film transistor.

7. The compensation circuit according to claim 6, wherein when the compensation circuit is pre-charged, the first clock signal is a high level, the second clock signal is a low level, the data signal is a low level, the first thin film transistor and the second thin film transistor are on, the fourth thin film transistor is off.

8. The compensation circuit according to claim 6, wherein when the compensation circuit is coding, the first clock signal is a low level, the second clock signal is a low level, the data signal is a low level, the first thin film transistor is off, the second thin film transistor is on, the fourth thin film transistor is off.

9. The compensation circuit according to claim 6, wherein when compensation circuit is driving to irradiate, the first clock signal is a low level, the second clock signal is a high level, the data signal is a high level, the first thin film transistor is off, the second thin film transistor is on, the third thin film transistor is on, the fourth thin film transistor is on.

10. A liquid crystal display device, wherein the liquid crystal display device comprises a backlight module and a display panel disposed on a light-emitting surface of the backlight module, the backlight module comprises an organic light-emitting diode and a compensation circuit, the compensation circuit is coupled to the organic light-emitting diode, the compensation circuit at least comprises:

a first switch unit, a first terminal of the first switch unit being coupled to a first reference voltage, a second terminal of the first switch unit being coupled to a first clock signal;

a second switch unit, a first terminal of the second switch unit being coupled to a third terminal of the first switch unit, a second terminal of the second switch unit being coupled to a predetermined voltage, a third terminal of the second switch unit being coupled to the organic light-emitting diode;

a third switch unit, a first terminal of the third switch unit being coupled to a second reference voltage, a third terminal of the third switch unit being coupled to the organic light-emitting diode, a fourth terminal of the third switch unit being coupled to a fourth terminal of the second switch unit;

a fourth switch unit, a first terminal of the fourth switch unit being coupled to a data signal, a second terminal of the fourth switch unit being coupled to a second clock signal, a third terminal of the fourth switch unit being coupled to the second terminal of the third switch unit;

wherein each of the first switch unit, the second switch unit, the third switch unit and the fourth switch unit corresponds to only one corresponding transistor respectively such that on/off state of each of the first switch unit, the second switch unit, the third switch unit and the fourth switch unit is determined by the only one corresponding transistor respectively, when the first switch unit is off, the second switch unit, the third switch unit and the fourth switch unit are on, the compensation circuit driving the organic light-emitting diode to irradiate, in order to compensate the organic light-emitting diode.

11. The liquid crystal display device according to claim 10, wherein when the organic light-emitting diode is irradiating, a current of the organic light-emitting diode satisfies a following formula:

$$I=\beta*(V\text{data}-V\text{pre})^2$$

where I is the current of the organic light-emitting diode; Vdata is a voltage value of the data signal; Vpre is a voltage value of the predetermined voltage.

12. The liquid crystal display device according to claim 10, wherein the first switch unit comprises a first thin film transistor, a first terminal of the first thin film transistor is connected to the first reference voltage, a second terminal of the first thin film transistor is connected to the first clock signal;

the second switch unit comprising a second thin film transistor and a first capacitor, a first terminal of the second thin film transistor being connected to a third terminal of the first thin film transistor, a second terminal of the second thin film transistor being connected to the predetermined voltage, a third terminal of the second thin film transistor being connected to a cathode of the organic light-emitting diode, one end of the first capacitor being connected to the first terminal and a fourth terminal of the second thin film transistor, the other end of the first capacitor being connected to ground.

13. The liquid crystal display device according to claim 12, wherein the third switch unit comprises a third thin film transistor, a first terminal of the third thin film transistor is connected to the second reference voltage, a third terminal of the third thin film transistor is connected to the cathode of the organic light-emitting diode, a fourth terminal of the third thin film transistor is connected to the fourth terminal of the second thin film transistor.

14. The liquid crystal display device according to claim 13, wherein the fourth switch unit comprises a fourth thin film transistor and a second capacitor, a first terminal of the fourth thin film transistor is connected to the data signal, a second terminal of the fourth thin film transistor is connected to the second clock signal, a third terminal of the fourth thin film transistor is connected to a second terminal of the third thin film transistor, one end of the second capacitor is connected to the third terminal of the fourth thin film transistor and the second terminal of the third thin film transistor, the other end of the second capacitor is connected to ground.

15. The liquid crystal display device according to claim 14, wherein the second thin film transistor and the third thin film transistor are double gate thin film transistors, the second terminal of the second thin film transistor is a bottom gate of the double gate thin film transistor, the fourth terminal of the second thin film transistor is a top gate of the double gate thin film transistor, the second terminal of the third thin film transistor is a bottom gate of the double gate thin film transistor, the fourth terminal of the third thin film transistor is a top gate of the double gate thin film transistor.

16. The liquid crystal display device according to claim 15, wherein when the compensation circuit is pre-charged, the first clock signal is a high level, the second clock signal is a low level, the data signal is a low level, the first thin film transistor and the second thin film transistor are on, the fourth thin film transistor is off.

17. The liquid crystal display device according to claim 15, wherein when the compensation circuit is coding, the first clock signal is a low level, the second clock signal is a low level, the data signal is a low level, the first thin film transistor is off, the second thin film transistor is on, the fourth thin film transistor is off.

18. The liquid crystal display device according to claim 15, wherein when compensation circuit is driving to irradiate, the first clock signal is a low level, the second clock signal is a high level, the data signal is a high level, the first thin film transistor is off, the second thin film transistor is on, the third thin film transistor is on, the fourth thin film transistor is on.

19. The compensation circuit according to claim 1, wherein the first clock signal has a high level and a low level, the second clock signal has a high level and a low level, and the data signal has a high level and a low level, the high level of the second clock signal is after the high level of the first clock signal and spaced from the high level of the first clock signal with a distance, and the high level of the second clock signal and the high level of the data signal simultaneously occur.

* * * * *